United States Patent [19]

Schiffers

[11] 4,131,977

[45] Jan. 2, 1979

[54] DEVICE FOR LIMITING THE ANGLE OF ADJUSTMENT OF AN ARTICULATEDLY SUPPORTED RAIL PAIR

[75] Inventor: Theo Schiffers, Würselen, Fed. Rep. of Germany

[73] Assignee: H. Krantz GmbH & Co., Würselen, Fed. Rep. of Germany

[21] Appl. No.: 887,430

[22] Filed: Mar. 16, 1978

[30] Foreign Application Priority Data

Mar. 26, 1977 [DE] Fed. Rep. of Germany ..... 7709567

[51] Int. Cl.[2] ..... D06C 3/02

[52] U.S. Cl. ..... 26/91

[58] Field of Search ..... 26/86, 89, 91

[56] References Cited

U.S. PATENT DOCUMENTS

| | | | |
|---|---|---|---|
| 2,375,990 | 5/1945 | Hinnekens | 26/91 |
| 2,577,880 | 12/1951 | Dodge | 26/86 X |
| 2,673,384 | 3/1954 | Roberts | 26/86 |

*Primary Examiner*—Robert Mackey

*Attorney, Agent, or Firm*—Arthur B. Colvin

[57] ABSTRACT

The present invention is directed to improvements in a tenter frame device, and more particularly relates to a means for enabling the rails of a tenter frame to be shifted transversely relative to the longitudinal axis of the rails and also for the rails to be angularly oriented with respect to each other, the device automatically maintaining the angular relation of the rails to each other within predetermined limits.

3 Claims, 4 Drawing Figures

-α
+α
1
2
3
10
4
8
9
5
6
7

11
10
17
8
15
9
13
12
14
16

10
8
17
16
9

10
8
17
16
9

DEVICE FOR LIMITING THE ANGLE OF ADJUSTMENT OF AN ARTICULATEDLY SUPPORTED RAIL PAIR

The invention relates to a device for limiting the angle of adjustment of an articulatedly supported rail pair which serves to guide the chains of a tenter frame and which can be moved by means of threaded spindles arranged crosswise to the longitudinal axis of the rails at the rail ends, two bevel gears being associated with said spindles.

Commercial tenter frames are equipped, for the continuous passage of fabric webs to be treated, with a chain pair, at the links of which tenter hook or needle holders are arranged. To introduce the still untensioned fabric web, and also for adaptation to different web widths, the chains are mounted on rails divided crosswise, rail sections being movable parallel as well as at an angle to the opposite rail sections, through threaded spindles. In the entrance area of the tenter frame, a rail pair diverging in running direction facilitates the introduction of the fabric web, as the rail pair is adjustable so that the fabric web can be seized in the untensioned state at the edges and be stretched to the desired width thereafter.

While the rail sections are adjustable in nearly any desired angle, depending on the form of their ends, hook or needle chains permit only a limited angle deviation from the straight running direction without undergoing damage because, as a certain flexural angle is exceeded, outer edges of the hooks, for example, may hit against each other so that they are deformed or their connections with the link are bent out of shape or destroyed. As an example of a conventional tenter frame assembly of the type hereinabove generally described, reference is made to U.S. Pat. No. 2,673,384.

It is the object underlying the invention to provide a device which assures an exactly defined limitation of the angle of adjustment of an articulatedly supported rail pair, using simple means.

SUMMARY OF THE INVENTION

Proceeding from the above described device, the invention proposes for the solution of the problem posed that the bevel gears comprise two coaxial drive spindles which can be coupled at their ends turned toward each other by a threaded/sliding sliding sleeve.

By the coupling of the drive spindles by means of a threaded/sliding sleeve according to the invention, a bevel gear drive can bring about, through the respective threaded spindle arranged crosswise to the longitudinal axis of the rails, a pivotal displacement of the rail until the threaded/sliding sleeve brings about a coupling of the two drive spindles, so that a further co-directional rotation of one spindle without the other is no longer possible and the second threaded spindle, arranged crosswise to the longitudinal axis of the rails, is driven along. The angle of adjustment reached at that moment can therefore not be exceeded.

According to an embodiment of the invention, the threaded/sliding sleeve consists of a collar which comprises at one end a cross-section constriction with continuous internal thread and at the other end, a cross-section constriction with a continuous groove coaxial to the collar.

The design of the threaded/sliding sleeve according to the invention makes it possible, with simple means, to couple the drive spindles in both directions of rotation outside a certain adjustment angle, whereas inside the specific adjustment angle, the two drive spindles are driveable independently of each other.

An especially advantageous embodiment of the invention provides that one drive spindle is threaded at the end turned toward the other, at least over the length of the displacement path of the threaded/sliding sleeve, and terminates with a run-up disk adapted to the inside diameter of the collar, while the other drive spindle has, at the end turned toward the former, a fitting key extending at least over the length of the displacement path of the threaded/sliding sleeve.

With this design of the device according to the invention, the threaded/sliding sleeve is set in rotation along with the rotation of the drive spindle provided with the fitting key, owing to which the threaded drive spindle strikes with the run-up disk against one or the other cross-section constriction.

An embodiment of the device of the invention is illustrated in the drawing forming a part hereof, and will be described in greater detail in the following:

In accordance with the drawings, a rail section 1 is movable parallel and also pivotally by means of drive motors 6, 7 acting through threaded spindles 2 and 3, to each of which spindles a bevel gear assembly 4, 5, respectively, is associated.

Figure 1:
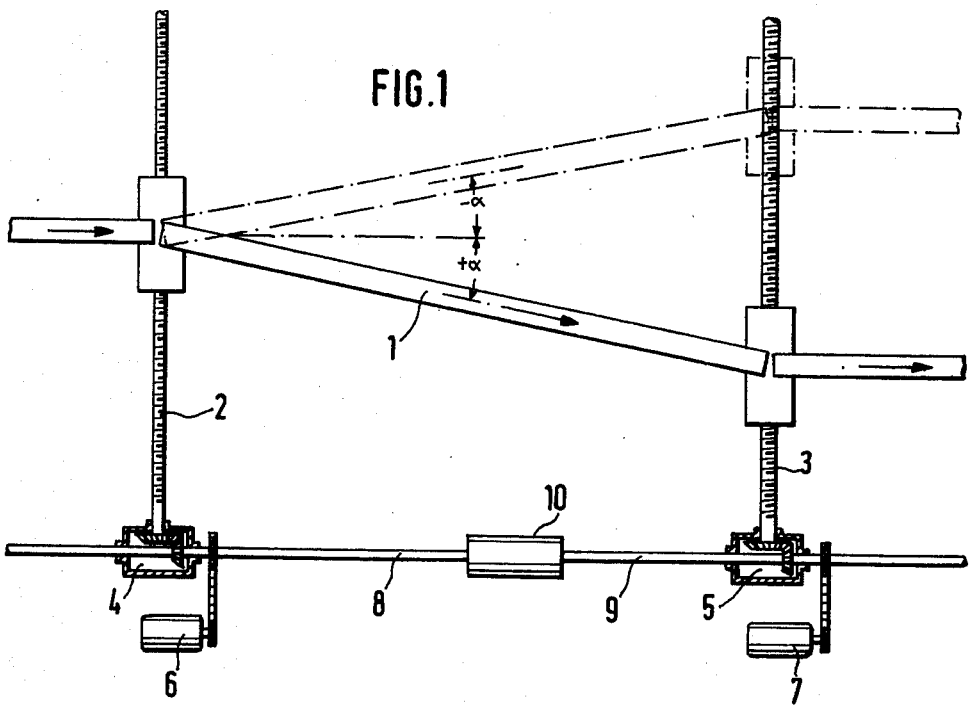
FIG. 1 is a diagrammatic representation of a chain rail of a tenter consisting of three rail sections, of which the central is pivoted by the angle + or − alpha.
Figure 2:
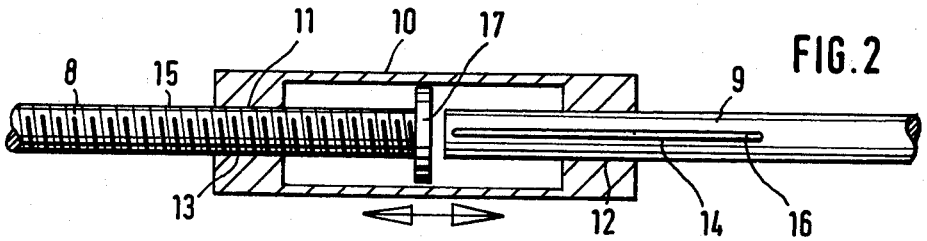
FIG. 2 is a cross-section of the threaded/sliding sleeve with the drive spindles, the rail sections being in rectilinear position.

To limit the displacement angles to which rail 1 may be inclined to +alpha and −alpha (see FIG. 1), the bevel gear assemblies 4 and 5 are coupled through the drive spindles 8 and 9 with the aid of a threaded/sliding sleeve 10 next to be described.

For coupling the drive spindles 8 and 9, the collar type threaded/sliding sleeve 10 has on each side a cross sectional constriction 11 and 12, the cross-section constriction 11 being equipped with an internal thread 13 and the cross-section constriction 12 with a groove 14. The end of the drive spindle 8 has an external thread 15 mating with the internal thread 13 of the sleeve, whereas the end of the drive spindle 9 has a fitting key 16 slidably and drivingly engaging groove 14.

Figure 3:
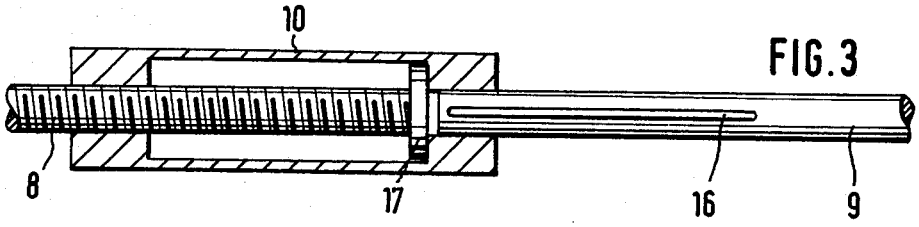
FIG. 3 is a view similar to FIG. 2 showing the position of the parts with the movable rail section pivoted at an angle + alpha.
Figure 4:
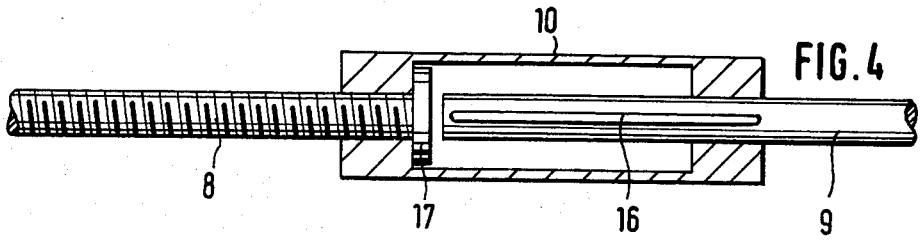
FIG. 4 is a view similar to FIG. 3 showing the position of the parts with the movable rail pivoted at an angle − alpha.

To limit the displacement path of the threaded/sliding sleeve 10, the drive spindle 8 ends with a run-up disk 17 whose outside diameter is slightly smaller than the inside of the collar, so that the run-up disk 17 can selectively come to bear against the cross-section constriction 11 or 12 of the threaded/sliding sleeve 10, as is illustrated in FIGS. 3 and 4.

The operation of the device will be apparent from the preceding description.

If the shafts powered by drive motors 6 and 7 are driven at the same speed, the shafts 2 and 3, through bevel gear assemblies 4 and 5, respectively, will be driven at the same speed and the rail section 1 will be shifted rectilinearly.

If the motors 6 and 7 are driven at differential speeds, the sleeve 10 will be shifted one way or the other within a limited range of movement, whereupon shafts 8 and 9 will, in effect, be keyed to each other, thus to limit the angular orientation of the rail 1 to an angle of + or − alpha. Specifically, if the shaft 9 is driven more rapidly than the shaft 8, the sleeve 10 will be rotated relative to the shaft 8 by virtue of the keyed connection between key 16 and groove 14, whereupon the parts will assume the position shown in FIG. 3, and further relative movement between shafts 8 and 9 in a direction which would increase the angle beyond alpha will be prevented. Conversely, if the shaft 8 should be rotated more rapidly than shaft 9, the parts will assume the position shown in FIG. 4, whereat the rail section 1 will be disposed at an angle of −alpha but will be precluded from further angular deviations.

Having thus described the invention and illustrated its use, what I claim as new and desire to be secure by Letters Patent is:

1. In a tenter frame device including a tiltably and transversely movable rail means for guiding the chains of a tenter frame, said rail means being connected to first and second threaded parallel spindles mounted transversely to the longitudinal axis of said rail means, apparatus for moving said rail means transversely while limiting the angular relation of said rail means to said spindles comprising first and second bevel gear assembles each including an output shaft coupled, respectively, to said first and second spindles, and an input shaft, said input shafts being coaxially aligned, independent drive means for rotating said input shafts of said gear assemblies, and angular limiter means for coupling said input shafts for conjoint rotation responsive to predetermined relative rotation of said input shafts, said limiter means comprising a sleeve threadedly connected to one said input shaft and shiftable axially relative to said shaft within predetermined limits responsive to relative rotation of said one shaft and sleeve, said sleeve being axially, slidably and non-rotatably connected to the other said input shaft.

2. Apparatus in accordance with claim 1 wherein the ends of said sleeve include constricted portions and said one input shaft includes an abutment movable within said sleeve between limiting positions defined by said constricted portions.

3. Apparatus in accordance with claim 2 wherein the sliding connection between said other shaft and said sleeve is defined by a key and groove arrangement.

* * * * *